US005342784A

United States Patent [19]

Yamada et al.

[11] Patent Number: 5,342,784

[45] Date of Patent: Aug. 30, 1994

[54] ELECTROPHOTOGRAPHIC LITHOGRAPHIC PRINTING PLATE

[75] Inventors: Jun Yamada; Seiji Shinohara, both of Tokyo, Japan

[73] Assignee: Mitsubishi Paper Mills Limited, Tokyo, Japan

[21] Appl. No.: 864,946

[22] Filed: Apr. 7, 1992

[30] Foreign Application Priority Data

Apr. 12, 1991 [JP] Japan ..... 3-108632

[51] Int. Cl.[5] ..... G03G 13/28

[52] U.S. Cl. ..... 430/49; 430/96; 430/204; 430/205; 430/300; 430/302; 430/304; 430/310

[58] Field of Search ..... 430/49, 96, 204, 205, 430/302, 304, 300, 310

[56] References Cited

U.S. PATENT DOCUMENTS 4,482,444 11/1984 Frass et al. ..... 430/302

*Primary Examiner*—John Kight, III

*Assistant Examiner*—Duc Truong

*Attorney, Agent, or Firm*—Cushman, Darby & Cushman

[57] ABSTRACT

Provided is an electrophotographic photoreceptor which comprises an electrically conductive support and a photoconductive layer comprising at least an organic photoconductive compound and an alkali and/or alcohol soluble binder resin provided on said support and which is used for making a lithographic printing plate therefrom by electrophotographically forming a toner image and decoating the photoconductive layer of non-image portion other than the toner image portion by contacting with an alkaline decoating solution, wherein an arithmetical mean deviation of profile ($Ra_1$) of the surface of said electrically conductive support having said photoconductive layer thereon is 0.3–1.0 μm and a ratio of $Ra_2/Ra_1$ of an arithmetical mean deviation of profile ($Ra_2$) of the surface of said photoconductive layer and the ($Ra_1$) is 0.5–1.0. The image formed on the printing plate is free from indentation at the edge of the image. Resolution and sharpness of the image are improved.

6 Claims, No Drawings

ELECTROPHOTOGRAPHIC LITHOGRAPHIC PRINTING PLATE

The present invention relates to an electrophotographic photoreceptor which comprises an electrically conductive support and a photoconductive layer provided on the support and from which a printing plate is made by forming a toner image by electrophotographic process and thereafter, removing the photoconductive layer of non-image portion other than the toner image portion and in particular, to an electrophotographic lithographic printing plate excellent in resolution of images formed on the plate, quite a little in staining of background and high in printing endurance.

In general, PS plate comprising an aluminum sheet coated with a photosensitive layer such as a diazo resin is known as a lithographic printing plate. A printing plate is made from the PS plate by contact exposing the surface photosensitive layer through a film original, thereby to form cured portion and uncured portion which correspond to the image portion and the non-image portion of the original, respectively and then, dissolving away, namely, decoating the non-image portion with an alkali or the like. However, since the PS plate is low in sensitivity, electrophotographic lithographic printing plates or silver salt lithographic printing plates are widely used for plate-making by projection exposure or laser exposure.

Hitherto, as printing plates which utilize the principle of electrophotographic technique, there have been known photosensitive materials for making offset printing plates which have zinc oxide/resin dispersion as a photosensitive layer as described in Japanese Patent Kokoku Nos. 47-47610, 48-40002, 48-18325, 51-15766, and 51-25761. In the case of such materials for offset printing plates, a toner image is formed by electrophotographic process and then, non-image portion other than the toner image portion is subjected to oil-desensitization treatment. However, these printing plates are poor in printing endurance because strength of the photosensitive layer is low and only at most 5000–10000 copies can be produced by such printing plates and thus, such printing plates are unsuitable for making a large number of copies. Besides, they have problems in environmental pollution and working conditions because acidic solutions such as hexacyanoferrate must be used for the oil-desensitization treatment.

Furthermore, as printing plates which use organic photoconductors contained in resins, Japanese Patent Kokoku Nos. 37-17162, 38-7758 and 46-39405 and Japanese Patent Kokai Nos. 52-2437, 57-161863, 58-2854, 58-28760, and 58-118658 disclose electrophotographic lithographic printing plates comprising a sandblasted aluminum sheet on which is provided a photoconductive layer comprising an oxazole or oxadiazole photoconductor and a sensitizing dye bound with a resin such as styrene/maleic anhydride copolymer. Moreover, Japanese Patent Kokai Nos. 54-134632, 55-165254, 59-12452, and 59-49555 disclose electrophotographic lithographic printing plates comprising a sandblasted aluminum sheet on which is provided a photoconductive layer comprising an organic photoconductive pigment bound with a resin such as phenol resin.

According to these general plate-making methods, a toner image is formed by electrophotographic image formation process and then, non-image portion other than the toner image portion is treated with a solution containing an alkali and/or an alcohol to dissolve away the photoconductive layer of the image portion from the plate (so-called decoating) and more generally, excess decoating solution and the solubilized photoconductive layer are removed by a washing solution having a pH of higher than the neutral and, if necessary, a plate surface protecting solution (protective gum solution) is coated on the plate surface. Printing plates made by these methods are superior in printing endurance since the image portion consists of not only the toner image portion, but also the photoconductive layer underneath the toner image portion and even if the toner image portion is worn off, the photoconductive layer maintains the function of the image portion.

Plate-making by electrophotographic process comprises imparting a surface charge to the photoconductive layer by corona discharging and the like, developing the electrostatic latent image formed by imagewise exposure with toner particles to form an image-like resist layer on the photoconductive layer and decoating (dissolving away) the non-image portion. Therefore, if unevenness is present in thickness of the photoconductive layer due to irregularities of the surface of support, this results in unevenness of surface potential and appears as difference in deposition amount of toner. Especially, in the case of laser exposure or projection exposure by camera, distribution of exposure quantity occurs at boundary (edge portion of image) between the image portion and the non-image portion and if the unevenness in thickness of the photoconductive layer as mentioned above is present in this boundary portion, the difference in deposition amount of toner appears as difference in resist strength and the edge portion of image after decoating of the non-image portion is indented to cause deterioration of resolution.

Usually, the surface of photoconductive layer is made as smooth as possible and in this case, unevenness in thickness of the photoconductive layer occurs corresponding to the surface irregularities of the support. In normal development (for example, photoconductive layer is negatively charged and development is carried out by positively charged toner), the line image is thick in the portion of thick photoconductive layer and the line image is thin in the portion of thin photoconductive layer. On the other hand, in the reversal development (for example, photoconductive layer is positively charged and development is carried out by positively charged toner), the line image is thin in the portion of thick photoconductive layer and the line image is thick in the portion of thin photoconductive layer. Such phenomena are peculiar to electrophotographic lithographic printing plates. When irregularity on the surface of support is made smaller, the image obtained becomes distinct, but adhesion of photoconductive layer to the support reduces and consequently, reduction of printing endurance is brought about. Besides, water retainability of the non-image portion is deteriorated and the plate cannot be used as a lithographic printing plate. When thickness of the photoconductive layer is increased, influence of the irregularity of the support relatively decreases, but in this case dissolution (decoating) of the photoconductive layer in the non-image portion becomes slower and becomes insufficient to cause formation of stain during printing. When dissolving power of the decoating solution is enhanced in order to completely decoat the non-image portion, side etching occurs much and fine lines disappear to cause deterioration of resolution. Furthermore, processing ability of the decoating solution decreases in proportion to increase of coating amount of the photoconductive layer.

An object of the present invention is to provide an electrphotographic photoreceptor for lithographic printing plate comprising a photoconductive layer provided on an electrically conductive support from which a printing plate high in resolution and sharpness of images formed thereon can be obtained.

Another object of the present invention is to provide an electrophotographic photoreceptor from which a printing plate high in printing endurance, little in stain of resulting prints and high in water retainability can be obtained.

The above objects can be attained by an electrophotograhic photoreceptor for lithographic printing plate in which an arithmetical mean deviation of profile ($Ra_1$) of the surface of an electrically conductive support on which a photoconductive layer is provided is 0.3–1.0 μm and ratio of an arithmetical mean deviation of profile (Ra2) of the surface of the photoconductive layer to ($Ra_1$), namely, [$Ra_2/Ra_1$] is 0.5–1.0.

The electrophotographic photoreceptor for lithographic printing plate of the present invention has at least a photoconductive layer on an electrically conductive support. The electrically conductive support used in the present invention includes, for example, plastic sheets having electrically conductive surface, paper-laminated sheets, and metallic sheets having hydrophilic surface such as aluminum and zinc sheets. Thickness of the support is preferably 0.07–2 mm, more preferably 0.1–0.5 mm. Among these supports, aluminum sheet is especially preferred. This aluminum sheet is mainly composed of aluminum and may additionally contain various other elements in small amounts and known materials may be optionally used.

If necessary, at least the surface of the electrically conductive support on which a photoconductive layer is provided is subjected to surface treatment. Known surface treating methods such as sandblasting and anodizing may be employed. If desired, the surface is subjected to degreasing treatment with a surfactant or an aqueous alkali solution prior to the sandblasting treatment. The sandblasting treatment includes, for example, mechanical surface toughening, electrochemical surface roughening and chemical selective surface dissolution. The mechanical surface roughening can be carried out by known methods such as ball abrasion, brush abrasion, blast abrasion and buff abrasion. The electrochemical surface roughening can be carried out in hydrochloric acid or nitric acid electrolyte using direct or alternating current. The mechanical and electrochemical surface roughening methods can be employed in combination as disclosed in Japanese Patent Kokai No. 54-63902.

In the present invention, the electrochemical surface roughening by electrolytes mainly composed of mineral acids is preferred which improves water retainability of the surface of the support and forms sandy surface roughness which is denser and more uniform than a certain level. Depth of the sandy roughness can be optionally set in a specific range by controlling electrolytic conditions as disclosed in Japanese Patent Kokoku No. 55-34240. The thus surface-roughened aluminum sheet is subjected to desmutting treatment and neutralizing treatment as required.

The treated aluminum sheet is subjected to anodization. As electrolytes used for the anodization, there may be used, for example, sulfuric acid, phosphoric acid, oxalic acid and mixtures thereof. Concentration of these electrolytes is optionally determined depending on the kind of the electrolytes. Anodization conditions cannot be generically specified because they greatly change depending on the electrolytes used, but generally the following conditions may be employed. Concentration of electrolyte: 1.0–80% by weight; temperature: 5.0°–70° C.; current density: 0.5–10 A/dm$^2$; voltage: 1.0–100 V; electrolysis time: 10–3000 seconds. Amount of the resulting anodic oxide film is preferably 0.10–10 g/m$^2$ more preferably 1.0–6.0 g/m$^2$.

Furthermore, an aluminum sheet treated with an aqueous alkali metal silicate solution after subjected to anodization treatment as mentioned in Japanese Patent Kokoku No. 47-5125 can also be suitably used. Moreover, electrodeposition of silicate described in U.S. Pat. No. 3,658,662 is also effective. Treatment with polyvinylsulfonic acid described in West German Patent Laid open Application No. 1621478 is also suitable. In the present invention, surface roughness of the electrically conductive support of the photoconductive layer side is evaluated by arithmetical mean deviation of profile ($Ra_1$) and is preferably in the range of 0.3–1.0 μm.

The surface roughness is used for algebraic expression, from a specific viewpoint, of one sectional shape of three-dimensional irregularity and shows various properties obtained from profile curve and roughness profile. The profile curve here means a transverse profile which appears at cut edge when a surface to be measured is cut along a plane perpendicular to the surface to be measured. In this case, unless otherwise notified, the surface is cut in the direction at which the maximum surface roughness appears. For example, in the case of the surface having directionality, it is cut in perpendicular to that direction.

The surface roughness can be obtained by various methods such as tracer method, topographiner, optical cutting method, repetition of interference method, sheen gloss, laser speckle, white light speckle, holographic interference, interference fringe contrast, and volumetric method. The surface profile of the electroconductive support on which the photoconductive layer is provided and that of the surface of the photoconductive layer are shown by the numerical values obtained by using a tracer contact type apparatus in view of scanning length and level of surface roughness.

A tracer type surface roughness measuring apparatus which directly reads arithmetical mean deviation of profile and the number of peak height of the profile has an electric filter which removes longer wavelength component in wavelength components constituting the section curve in order to remove so-called surface wariness component. Therefore, the arithmetical mean deviation of profile is directly shown using a curve (called roughness profile) different from the profile curve.

The arithmetical mean deviation of profile (average roughness value) Ra is given by the following formula and expressed by μm unit when the portion of sampling length L to be measured in the direction of arithmetical mean line (also called center line) is extracted from profile curve and the profile curve is expressed by Z=f(x) in the case of the center line of the extracted portion being x-axis and the direction of profile departure being Z-axis.

$$Ra=(1/L)\cdot\int|f(x)|\,dx\ (\mu m)$$

That is, Ra denotes a mean deviation obtained by dividing the area surrounded by the profile curve and the center line by the measured length.

The arithmetical mean deviation of the profile in the present invention is defined in JIS B0601 as shown by the above formula and an average value obtained by measurement of 10 times under the conditions of cut-off value 0.08 mm, measured length 0.5 mm and scanning rate 0.06 mm/sec is employed as Ra in the present invention. The measured position is the central portion of printing plate and direction of measurement is perpendicular to the direction of rolling of aluminum sheet. Respective measurements are conducted in the same direction and at an equal interval of 50–100 μ. Furthermore, size and valley of irregularities of the surface treated support employed in the present invention are finer than conventional ones and cannot be evaluated by a stylus of 5 μwhich is taken as standard stylus. Therefore, a Stylus having a curvature radius at its tip of 1 μ is used in the present invention. As a measuring apparatus, Sasucom 570A manufactured by Tokyo Seimitsu Co., Ltd. is used and as an analysis apparatus, SAS-2010 (digital type) manufactured by Meishin Koki Co., Ltd. is used in the present invention. Data taking up pitch in the direction of X axis is 0.2 μm or less.

A known electrophotographic photoconductive layer is provided on the thus obtained electrically conductive support to obtain an electrophotographic photoreceptor. It is necessary in the present invention to coat the photoconductive layer along the irregularities of the rough surface of the support so that difference in thickness of the photoconductive layer occurs as little as possible. Such difference in thickness can be directly examined by cutting the electrically conductive support coated with the photoconductive layer and observing the section, but only local evaluation can be conducted according to this method. It has been found in the present invention that average evaluation in place of the above direct evaluation can be conducted by measuring the surface roughness of the photoconductive layer and obtaining the arithmetical mean deviation of profile. Arithmetical mean deviation of profile ($Ra_2$) of the surface of the photoconductive layer is determined depending on the arithmetical mean deviation of profile ($Ra_1$) of the surface treated electrically conductive support and the ratio $Ra_2/Ra_1$ is preferably in the range of 0.5–1.0 when $Ra_1$ is in the range of 0.3 –1.0 μm.

Known organic compounds can be used as photoconductive materials for the photoconductive layer.

As examples of the organic photoconductive materials, mention may be made of the following compounds.

(a) Triazole derivatives described in U.S. Pat. No. 3,112,197.

(b) Oxadiazole derivatives described in U.S. Pat. No. 3,189,447.

(c) Imidazole derivatives described in Japanese Patent Kokoku No. 37-16096.

(d) Polyarylalkane derivatives described in U.S. Pat. Nos. 3,542,544, 3,615,402 and 3,820,989, Japanese Patent Kokoku Nos. 45-555 and 51-10983, and Japanese Patent Kokai Nos. 51-93224, 55-108667, 55-156953 and 45-36636.

(e) Pyrazoline derivatives and pyrazolone derivatives described in U.S. Pat. Nos 3,180,729 and 4,278,746 and Japanese Patent Kokai Nos. 55-88064, 55-88065, 49-105537, 55-51086, 56-80051, 56-88141, 57-45545, 54-112637 and 55-74546.

(f) Phenylenediamine derivatives described in U.S. Pat. No. 3,615,404, Japanese Patent Kokoku Nos. 51-10105, 46-3712 and 47-28336 and Japanese Patent Kokai Nos. 54-83435, 54-110836 and 54-119925.

(g) Arylamine derivatives described in U.S. Pat. Nos. 3,567,450, 3,180,703, 3,240,597, 3,658,520, 4,232,103, 4,175,961 and 4,012,376, West German Patent (DAS) No. 1110518, Japanese Patent Kokoku Nos. 49-35702 and 39-27577, and Japanese Patent Kokai Nos. 55-144250, 56-119132 and 56-22437.

(h) Amino-substituted chalcone derivatives described in U.S. Pat. No. 3,526,501.

(i) N,N-bicarbazyl derivatives described in U.S. Pat. No. 3,542,546.

(j) Oxazole derivatives described in U.S. Pat. No. 3,257,203.

(k) Styrylanthracene derivatives described in Japanese Patent Kokai No. 56-46234.

(l) Fluorenone derivatives described in Japanese Patent Kokai No. 54-110837.

(m) Hydrazone derivatives described in U.S. Pat. No. 3,717,462, Japanese Patent Kokai Nos. 54-59143 (corresponding to U.S. Pat. No. 4,150,987), 55-52063, 55-52064, 55-46760, 55-85495, 57-11350, 57-148749 and 57-104144.

(n) Benzidine derivatives described in U.S. Pat. Nos. 4,047,948, 4,047,949, 4,265,990, 4,273,846, 4,299,897, and 4,306,008.

(o) Stilbene derivatives described in Japanese Patent Kokai Nos. 58-190953, 59-95540, 59-97148, 59-195658 and 62-36674.

(p) Polyvinylcarbazole and derivatives thereof described in Japanese Patent Kokoku No. 34-10966.

(q) Vinyl polymers such as polyvinylpyrene, polyvinylanthracene, poly-2-vinyl-4-(4'-dimethylaminophenyl)-5-phenyloxazole and poly-S-vinyl-N-ethyl-carbazole described in Japanese Patent Kokoku Nos. 43-18674 and 43-19192.

(r) Polymers such as polyacenaphthylene, polyindene and acenaphthylene/styrene copolymers described in Japanese Patent Kokoku No. 43-19193.

(s) Condensation resins such as pyrene/formaldehyde resin and ethylcarbazole/formaldehyde resin described in Japanese Patent Kokoku No. 56-13940.

(t) Various triphenylmethane polymers described in Japanese Patent Kokai Nos. 56-90883 and 56-161550.

(u) Metal-free or metal (oxide) phthalocyanine and naphthalocyanine and derivatives thereof described in U.S. Pat. Nos. 3,397,086 and 4,666,802, Japanese Patent Kokoku Nos. 44-121671, 46-30035, 49-17535, and japanese Patent Kokai Nos. 49-11136, 51-90827, 52-655643, 57-148745, 64-2061 and 64-4389.

The organic photoconductive compounds used in the present invention are not limited to those enumerated in the above (a) to (u) and any of known organic photoconductive compounds can be used. These organic photoconductive compounds may be used each alone or in combination of two or more as required.

The photoconductive layer for electrophotographic photoreceptor for lithographic printing plate according to the present invention comprises at least an organic photoconductive compound and an alkali and/or alcohol soluble binder resin. Since photoconductive layer of the non-image portion must be finally removed and this step is determined by relative relationship of solubility of the photoconductive layer in the decoating (dissolving) solution, amount of toner deposited on the image portion and resist property of the image portion, it cannot be generally expressed, but at least the binder resin is preferably a polymeric compound soluble or dispersible in the decoating solution.

Examples of the binder resin are copolymers of styrene, methacrylate ester, acrylate ester, vinyl acetate, vinyl benzoate and the like with carboxylic acid-containing monomers or acid anhydride-containing monomers such as acrylic acid, methacrylic acid, itaconic acid, crotonic acid, maleic acid, maleic anhydride and fumaric acid such as styrene/maleic anhydride copolymer, styrene/maleic acid monoester copolymer, methacrylic acid/methacrylate copolymer, styrene/methacrylic acid/methacrylate copolymer, acrylic acid/methacrylate copolymer, styrene/acrylic acid/methacrylate copolymer, vinyl acetate/crotonic acid copolymer, and vinyl acetate/crotonic acid/methacrylate copolymer; copolymers containing monomers such as methacrylamide, vinylpyrrolidone, acryloylmorpholine, and those having phenolic hydroxyl group, sulfonic acid group, sulfonamide group or sulfonimide group; phenolic resin, partially saponified vinyl acetate resin, xylene resin and vinyl acetal resin such as polyvinyl butyral resin.

Copolymers containing monomers having acid anhydride group or carboxylic acid group and phenolic resins are high in charge retainability when used in photoreceptors for electrophotographic printing plates and accordingly, can be advantageously used. As the copolymers containing monomers having acid anhydride group, preferred is a copolymer of styrene and maleic anhydride. As the copolymers containing monomers having carboxylic acid group, preferred are copolymers of styrene and maleic acid monoester and hi- or higher copolymers of acrylic acid or methacrylic acid with its alkyl ester, aryl ester or aralkyl ester. Copolymer of vinyl acetate and crotonic acid is also preferred. As phenolic resins especially preferred are novolak resins obtained by condensation of phenol, o-cresol, m-cresol or p-cresol with methanal or ethanal under acidic conditions. The binder resins may be used each alone or in combination of two or more.

When only the photoconductive compound and the binder resin are used and content of the photoconductive compound is low, sensitivity decreases and hence, it is suitable to mix the photoconductive compound (P) with the binder resin (B) at a P/B (by weight) of preferably 1/20 or more, more preferably 1/6 or more.

The electrophotographic photoreceptor for lithographic printing plate of the present invention can be obtained by coating a photoconductive layer on an electrically conductive support by conventional methods. For preparation of the photoconductive layer, there are known, for example, a method of containing the components constituting the photoconductive layer in the same layer and a method of containing them separately in two or more layers, such as one in which a carrier generating material and a carrier transporting material are used separately in different layers. The photoconductive layer can be prepared by any methods. Coating solution is prepared by dissolving each component constituting the photoconductive layer in a suitable solvent. When a component insoluble in solvents such as a pigment is used, it is dispersed to 0.01–5 μm, more preferably 0.05–0.2 μm in average particle size by dispersing devices such as ball mill, paint shaker, dyno mill and attritor. The binder resin and other additives used in photoconductive layer can be added during or after dispersion of the pigment and others.

The electrophotographic photoreceptor for lithographic printing plate can be produced by coating the thus prepared coating solution on a support by known methods such as rotation coating, blade coating, knife coating, reverse-roll coating, dip coating, rod bar coating, spray coating, and extrusion coating and then drying the coat. In this case, important is the time of from application of the solution to the support to drying of the applied coat, namely, so-called setting time. For example, in case a long time is required until the solvent is evaporated by drying after application of the coating solution, the solution fills the dents on the roughened surface of the support to smoothen the surface of the photoconductive layer after dried and thus to cause increase in difference between the thickness of the photoconductive layer on the protruded portions of the support and the thickness of the photoconductive layer on the dented portions of the support. Therefore, in the present invention, it is desired to select viscosity of the coating solution (solid concentration, solvent) and coating and drying conditions so that the ratio of roughness $Ra_1$ of the surface of the electrically conductive support and roughness $Ra_2$ of the surface of the photoconductive layer ($Ra_2/Ra_1$) is within the range of 0.5–1.0. For example, when viscosity of the coating solution is 40–100 cp, it is desired to carry out rapid drying so as to shorten the setting time of coated photoconductive layer, for example, by raising drying temperature in dryer zone of coater, increasing rate of air, or increasing coating speed so that the photoconductive layer enters into the dryer zone in a possible shorter time (within about 10 seconds) after application of the coating solution.

Coating amount of the photoconductive layer is not critical, but preferably 5 $g/m^2$ or less, more preferably 1.5–4 $g/m^2$. If the coating amount is too much, charged potential can be retained, but considerable side etching occurs by decoating of the non-image portion and if it is too small, there occurs local omission of the layer and uniform coating is difficult. The present invention is advantageous for improvement in resolution of images, decrease in side etching in decoating and improvement of processing ability of decoating solution.

Printing plates can be made from the electrophotographic photoreceptor for lithographic printing plates by conventional methods. That is, the photoreceptor is substantially uniformly charged by corona discharging or the like in the dark and an electrostatic latent image is formed by imagewise exposure. As the exposing methods, mention may be made of reflex imagewise exposing and contact exposing through a transparent positive film using xenon lamp, tungsten lamp, fluorescent lamp or the like as a light source and scanning exposing by laser beam, light emitting diode and the like. The scanning exposing can be carried out by laser beam sources, for example, He-Ne laser, He-Cd laser, argon ion laser, krypton ion laser, ruby laser, YAG laser, nitrogen laser, dye laser, excimer laser, semiconductor lasers such as GaAs/GaAl As and InGaAsP, alexandrite laser and copper vapor laser, or scanning exposing using light emitting diode and liquid crystal shutter (including line printer type light sources using light emitting diode arrays and liquid crystal shutter arrays).

More or less there occurs distribution in exposure quantity at the boundary between the image portion and the non-image portion by employing any exposing method and correspondingly the deposition amount of toner continuously reduces from the deposition amount at which resist property can be retained to the deposition amount at which resist property cannot be retained at the boundary. In the case of the electrophotographic photoreceptor having $Ra_2/Ra_1$ of 0.5–1.0 of the present invention, uneveness in charged potential is small and the boundary between the image portion and the non-image portion after plate-making is formed along the irregularity on the surface of the support and deviation of line width can be actually ignored.

Then, the electrostatic latent image is developed with toner. The development can be carried out by either dry development (cascade development, magnetic brush development, powder cloud development) or liquid development. Especially, liquid development can form fine toner images and is suitable for making printing plates of superior reproducibility. Furthermore, there can be employed the positive/positive development according to normal development and the negative/-positive development according to reversal development under application of a suitable bias voltage. The thus formed toner image can be fixed by known fixing methods such as heating fixation, pressure fixation and solvent fixation. The photoconductive layer of non-image portion is removed by decoating solution with using the toner image as a resist and thus, a printing plate can be made.

The electrophotographic photoreceptor after subjected to the development with toner can be made to a printing plate by treating the photoconductive layer of non-image portion with a processing solution under allowing the toner image to act as resist. Thus, a printing plate can be made.

The processing solution and the processing method used in the present invention will be explained below.

As the decoating solution which dissolves and remove the photoconductive layer of non-image portion, there may be used any solutions which solubilize at least the binder resin and there are no special limitations. Preferred are those which contain alkali agents and have a buffer action. As examples of the alkali agents, mention may be made of inorganic alkali agents such as silicates represented by the formula $SiO_2M_2O$ (M=Na, K), alkali metal hydroxides, and alkali metal salts and anunonium salts of phosphoric acid and carbonic acid, organic alkali agents represented by amines such as ethanolamine and propanediamine, and mixtures thereof. Especially, the above silicates are advantageous because they show strong buffer action. A mixture of the silicates with alkali metal hydroxides are desired in formulation.

The decoating solutions used in the present invention preferably contain surface active agents for improvement in wettability of the surface of the photoconductive layer and accompanying improvement in decoating ability and expansion of decoating conditions. Examples of preferred surface active agents are anionic surface active agents such as alkylbenzenesulfonates (carbon number of the alkyl group being preferably 8–18, more preferably 12–16), alkylnaphthalenesulfonates (carbon number of the alkyl group being 3–10), formalin condensates of naphthalenesulfonic acid, dialkylsulfosuccinates (carbon number of the alkyl group being 2–18), and dialkylamidosulfonates (carbon number of the alkyl group being 11–17) and amphoteric surface active agents such as imidazoline derivatives, carboxybetaines, aminocarboxylic acids, sulfobetaines, aminosulfate esters, and imidazolines.

The decoating solutions may additionally contain known components such as ionic compounds described in Japanese Patent Kokai No. 55-25100, water-soluble cationic polymers described in Japanese Patent Kokai No. 55-95946, water-soluble amphoteric polymer electrolytes described in Japanese Patent Kokai No. 56-142528, neutral salts described in Japanese Patent Kokai No. 58-75152, chelating agents described in Japanese Patent Kokai No. 58-190952, liquid viscosity regulators described in Japanese Patent Kokai No. 1-177541, preservatives and fungicides described in Japanese Patent Kokai No. 63-226657, and antifoamers and natural and synthetic water-soluble polymers described in U.S. Pat. Nos. 3,250,727 and 3,545,970 and British Patent Nos. 1382901 and 1387713.

Solvents used for the decoating solution have no special limitation as far as they can stably disperse and dissolve the above components, but water and more preferably deionized water can be advantageously utilized. Furthermore, a suitable amount of organic solvents may be contained in order to more highly stabilize the above components or to control the decoating speed.

For making the electrophotographic lithographic printing plate of the present invention, automatic decoating machines are preferred and more preferred are those which have a construction comprising a decoating part, a water washing part and a surface protective agent coating part, but there are no limitations in means of the respective parts as far as the lithographic printing plates can be automatically carried and decoated and rinsed (washed with water). However, considering deterioration with time of the decoating solution, the decoating solution is desirably fed onto the surface of the photoconductive layer as softly as possible since there is the possibility of accelerating the deterioration due to flowing of the solubilized photoconductive layer in a large amount from the surface of the plate into the decoating solution in the decoating part. For soft feeding of the decoating solution, it is suitable to uniformly feed the solution discharged from a feed pipe of the solution through other members such as a rectifying plate and a top roll for carrying the printing plate. Discharging amount of the decoating solution in this case can be minimum amount which can be evenly fed onto the printing plate, but is preferably 1.5–100 times, more preferably 5.0–50 times the amount of the solution which the printing plate takes out when carried to the water washing part. The amount of the solution taken out by the plate is as small as possible and it is preferred to mechanically control the amount to 10 $g/m^2$ or less.

The water washing part must have such mechanism as can feed the washing liquid onto the surface of the plate and completely and rapidly remove the solubilized photoconductive layer and excess decoating solution. If it has a mechanism which can inhibit scattering of the liquid, the liquid may be directly fed to the solubilized photoconductive layer or a decoating acceleration member described in Japanese Patent Kokai No. 60-76395 may be applied to the water washing mechanism. It is also possible to scrape off the solubilized photoconductive layer by directly contacting a rotating brush with the photoconductive layer in the water washing part. However, use of the brush is not desirable since usually the solubilized photoconductive layer can be easily removed without mechanical scraping and besides, use of the brush may cause too much side etching.

The electrophotographic lithographic printing plate washed with water is, if necessary, treated with a rinsing solution containing an acidic substance. The rinsing solution usable in the present invention is preferably adjusted in its pH so that the binder resin in the photoconductive layer subjected to plate-making treatment does not reagglomerate. That is, if the initial pH of the rinsing solution does not accelerate insolubilization of the binder resin at minimum, the binder resin which flows together with water washing liquid having a pH of higher than neutral maintains the solubilized state at least during circulation of solution and passing of the printing plate and thus, the above troubles caused by reinsolubilization of the binder resin can be inhibited. However, since the rinsing solution though in a slight amount flows into a protective gum solution used for protection of the plate surface normally conducted thereafter, if pH of the rinsing solution is high, pH of the protective gum solution naturally and early rises, resulting in reduction of surface protecting effect. Thus, it is desired to maintain pH of the rinsing solution at 7 or lower.

Various materials can be added to this rinsing solution in order to adjust the pH. Especially, for more stably processing many electrophotographic lithographic printing plates by an automatic decoating machine or the like, it is desired that pH of the rinsing solution also does not vary during making many printing plates. Therefore, the rinsing solution desirably contains at least acids or water-soluble salts as buffers. Thus, when the rinsing solution is applied to the electrophotographic lithographic printing plate, basic components resulting from the decoating solution remaining on the plate is neutralized and the non-image portion is rendered more hydrophilic.

After removing the photoconductive layer of non-image portion, the resulting printing plate is subjected to protective gum treatment for improvement of flaw resistance of the plate surface and oil-desensitization of non-image portion. The protective gum solutions usable in the present invention contain polymer compounds, oleophilic substances, surface active agents and the like which are all known materials.

The present invention will be explained in more detail by the following nonlimiting examples.

EXAMPLE 1

An aluminum sheet of JIS 1050 was dipped in an aqueous NaOH solution at 60° C. for 1 minute to effect etching so that dissolution amount of aluminum reached 0 4.5 g/m$^2$. The aluminum sheet was washed with water then neutralized by dipping in a 30% aqueous nitric acid solution for 1 minute, and then thoroughly washed with water. Then, the sheet was subjected to electrolytic surface roughening at 25 A/dm$^2$ in 2.0% aqueous hydrochloric acid solution for 45 seconds, then dipped in 2% aqueous NaOH solution at 30° C. to wash the surface and thereafter, washed with water. This sheet was further subjected to anodic oxidation in 20% aqueous sulfuric acid solution to form an aluminum oxide film on the surface, washed with water and then dried to make a support for printing plate. In this case, arithmetical mean diviation of the profile ($Ra_1$) of the treated surface of the support was 0.75 $\mu$m.

Preparation of Coating Solution for Photoconductive Layer and Coating Thereof The following photoconductive layer composition dispersed for 1 hour in a paint shaker was coated by a bar coater on the treated surface of the support obtained above and was immediately set by hot-air rapid drying with application of hot air blown out at a distance of 10 cm from the plate at a blowing temperature of 100° C. and a blowing rate of 20 min by moving 1 kw hair dryer from side to side. Thus, an electrophotographic photoreceptor for lithographic printing plate was produced. The setting time in this case was 30 seconds. The coating amount of the photoconductive layer was 3.0 g/m$^2$ and arithmetical mean deviation of the profile ($Ra_2$) of the surface was 0.42 $\mu$m. (That is, $0.5 < Ra_2/Ra_1 < 1.0$.)

| Composition of photoconductive layer coating solution 1: | Part by weight |
|---|---|
| Butyl methacrylate/methacrylic acid copolymer (methacrylic acid 40 mol %) | 5.5 |
| X type metal-free phthalocyanine | 1.5 |
| 1,4-Dioxane | 75 |
| 2-Propanol | 8 |
| Viscosity (Brookfield type viscometer rotor No. 1, 60 rpm) 50 cp | |

Toner Development

The resulting photoreceptor was subjected to corona discharging in the dark to charge it so as to give a surface potential ($V_0$) of about +300 V. Thereafter, it was subjected to imagewise scanning exposure using semiconductor laser (780 nm) and immediately, the latent image was subjected to liquid reversal development with positively charged toner (LOM-ED III manufactured by Mitsubishi Paper Mills Ltd.) and the toner was fixed-by heating, whereby a toner image of 50 lines/nun in resolution with no indentation at edge of line image along the irregularity on the surface of the photoconductive layer was obtained in high reproducibility. Sharpness of the image was also superior.

Plate-Making Treatment

Next, plate-making treatment was carried out using the following automatic decoating machine, decoating solution, water washing solution and rinsing solution.

(1) Automatic Decoating Machine

The automatic decoating machine used had a decoating tank, and subsequent water washing tank and rinsing tank, and a driving apparatus for carrying the electrophotographic lithographic printing plate developed with toner, an apparatus for circulating the treating solution of each treating tank at the cycle of reservoir→pump→spraying nozzle→reservoir, and a replenishing apparatus for each treating tank.

| | Part by weight |
|---|---|
| (2) Composition of decoating solution 1 | |
| Aqueous sodium silicate solution ($SiO_2$ content 30% by weight, $SiO_2/Na_2O$ molar ratio 2.5) | 20 |
| Potassium hydroxide | 1 |
| Pure Water | 79 |
| (3) Composition of water washing solution 1 (20 dm$^3$) | |

-continued

| | Part by weight |
|---|---|
| Sodium dioctylsulfosuccinate | 0.1 |
| 2-Methyl-3-isothiazolone | 0.01 |

The above components were dispersed and dissolved in pure water to obtain 100 parts by weight of a solution. This solution was charged in the water washing tank and after making 100 plates, 15 ml of 5 wt % aqueous glycine solution was added after treating of every 10 printing plates of A2 size.

| (4) Composition of rinsing solution 1 (20 $dm^2$) | Part by weight |
|---|---|
| Succinic acid | 0.5 |
| Phosphoric acid (85% aqueous solution) | 0.5 |
| Decaglyceryl monolaurate | 0.05 |
| 2-Methyl-3-isothiazolone | 0.01 |

Sodium hydroxide was added to the above components to adjust pH to 4.7 and then, the total amount was made to 100 parts by weight with pure water.

Plate-making was carried out using the above treating solutions (decoating time was set at 6 seconds) to obtain an image of constant line width with no indentation at the edge of lines along the irregularity on the surface of the support. No troubles such as delay in decoating of non-image portion (remaining of pigment) were seen in all of the printing plates made here.

Printing was carried out using these printing plates by an offset printing machine (Hamadastar 600 CD) to obtain at least 100,000 prints with good quality and no stains.

COMPARATIVE EXAMPLE 1

The photoconductive layer coated by bar coater in Example 1 was allowed to stand for 30 seconds and slowly dried for 5 minutes by an oven of 2 m/min in an air flow rate at 90° C. Setting time in this case was 120 seconds. Arithmetical mean deviation of the profile of the surface ($Ra_2$) was 0.24 μm ($Ra_2/Ra_1<0.5$). The resulting electrophotographic photoreceptor was developed and treated to make a printing plate in the same manner as in Example 1. Local unevenness in the thickness of the photoconductive layer was great and the photoconductive layer was thin and surface potential was low on the protrudent portion of the support and the photoconductive layer was thick and surface potential was high on the dent portion of the support. The edge Of line images on the printing plate had indentation. Therefore, resolution of image considerably lowered.

EXAMPLE 2

The coating solution for photoconductive layer used in Example 1 was used and discharging amount thereof was adjusted so that coating amount of the photoconductive layer after dried was 3.5 g/$m^2$ and the coating solution was continuously coated by fountain type coater to obtain an electrophotographic photoreceptor for lithographic printing plate. In this case, coating rate was 30 m/min, the time until the printing plate enters into dryer zone after application of the coating solution was 5 seconds, and length of each dryer zone and drying temperature and air flow rate in each dryer zone were respectively as follows. The first zone: 5 m, 120° C., 5 m/min; the second zone: 5 m, 140° C., 7.5 m/min, the third zone: 10 m, 140° C., 10 m/min. Setting time was 20 seconds. The arithmetical mean deviation of the profile ($Ra_2$) of the surface was 0.5 μm (namely, $0.5<Ra_2/Ra_1<1.0$).

The resulting photoreceptor was developed and printing plate was made therefrom in the same manner as in Example 1. A toner image with no indentation at the edge of lines along the irregularity of the surface of the photoconductive layer and with a resolution of 50 lines/nun was obtained in high reproducibility. Sharpness of the image was also high.

COMPARATIVE EXAMPLE 2

In Example 2, the coating rate was changed to 10 m/min and the discharging amount of the coating solution was adjusted so that coating amount of the photoconductive layer after dried was 3.5 g/$m^2$ and drying temperature and air flow rate in each dryer zone were respectively set as follows. The first zone: 90° C., 3 m/min; the second zone: 120° C., 5 m/min, the third zone: 140° C., 10 m/min. In this case, the setting time was 75 seconds. The arithmetical mean deviation of the profile ($Ra_2$) of the surface was 0.2 μm ($Ra_2/Ra_1<0.5$).

The resulting photoreceptor was developed and printing plate was made therefrom in the same manner as in Example 1. Local unevenness in thickness of the photoconductive layer was large. The photoconductive layer was thin and surface potential was low on the protruded portion of the support and the photoconductive layer was thick and surface potential was high on the dent portion of the support. The edge of line images on the printing plate had indentation. Therefore, resolution of image considerably lowered.

EXAMPLE 3 to 7

A new support was produced as in Example 1 except that the current density in surface roughening in the surface treating step of electrically conductive support was changed. The coating solution 1 for photoconductive layer was coated thereon in the same manner as in Example 1 to obtain electrophotographic photoreceptor having the surface configuration as shown in Table 1.

TABLE 1

| | Arithmetical mean deviation of the profile (μm) | | | |
|---|---|---|---|---|
| | Surface of support ($Ra_1$) | Surface of photoconductive layer ($Ra_2$) | $Ra_2/Ra_1$ | Coating amount of photoconductive layer (g/$m^2$) |
| Example 3 | 0.35 | 0.22 | 0.63 | 2.0 |
| Example 4 | 0.47 | 0.30 | 0.64 | 3.0 |
| Example 5 | 0.58 | 0.42 | 0.72 | 3.0 |
| Example 6 | 0.66 | 0.40 | 0.61 | 3.5 |
| Example 7 | 0.93 | 0.79 | 0.85 | 4.5 |

All of the electrophotographic photoreceptors obtained above were subjected to development treatment and plate-making treatment under the same conditions as in Example 1. As in Example 1, in all of the printing plates after developed, toner images of 50 lines/mm in resolution with no indentation at the edges of lines along the irregularity on the surface of the photoconductive layer were obtained in high reproducibility. Furthermore, images obtained by decoating the non-image portion had constant line width with no indentation at the edge of lines along the irregularity on the surface of the support. The decoating property and printing endurance (100,000 copies) were similarly superior and there were no problems.

COMPARATIVE EXAMPLE 3

Coating solution 2 for photoconductive layer was prepared by reducing the amount of the dioxane solvent of coating solution 1 and adjusting the solid concentration to 12%. This coating solution 2 was coated on the support of Example 3 and dried in the same manner as in Example 1 to make an electrophotographic photoreceptor for lithographic printing plate. Coating amount of the photoconductive layer was 4.0 g/m$^2$ and arithmetical mean deviation of the profile ($Ra_2$) of the surface was 0.53. That is, $Ra_2/Ra_1=1.5$.

The edge of the image formed was observed to find that side etching occurred much and the edge of the image had indentation as in Comparative Example 1 and the side-etching was larger and resolution deteriorated than in Example 3.

COMPARATIVE EXAMPLES 4 TO 6

New supports were produced as in Example 1 except that the current density in surface roughening in the surface treating step of electrically conductive support was changed to obtain the supports having the surface configuration as shown in Table 2.

TABLE 2

| Comparative Example | Arithmetical mean deviation of the profile (μm) Surface of support ($Ra_1$) | Surface of photoconductive layer ($Ra_2$) | $Ra_2/Ra_1$ |
|---|---|---|---|
| 4 | 0.26 | 0.16 | 0.62 |
| 5 | 1.1 | 0.33 | 0.30 |
| 6 | 1.5 | 0.35 | 0.23 |

The coating solution 1 for photoconductive layer was coated thereon in the same manner as in Comparative Example 1 and was slowly dried for 5 minutes by a dryer of 90°0 C. All of the resulting electrophotographic photoreceptors were developed and printing plates were made therefrom under the same conditions as in Example 2. As a result, on the printing plate obtained in Comparative Example 4 a toner image of 50 lines/mm in resolution was obtained in high reproducibility and sharpness of the image was good, but the printing plate was inferior in printing endurance and the photoconductive layer peeled off during printing and defects occurred in the printed copies.

On the other hand, in Comparative Example 5 and 6, unevenness in thickness of the photoconductive layer was large to cause nonuniformity in deposition amount of toner. Besides, the edge of the image was indented and resolution of the toner image deteriorated as in Comparative Example 1. Furthermore, the photoconductive layer of the non-image portion in the dent portions on the surface of the support was not sufficiently decoated (dissolved away) and remained therein and in addition, degree of side etching greatly changed and fine lines of toner partly disappeared.

EXAMPLE 8

An aluminum sheet of JIS 1050 was dipped in an aqueous NaOH solution at 60° C. for 1 minute to effect etching so that dissolution amount of aluminum reached 4.5 g/m$^2$. The aluminum sheet was washed with water then neutralized by dipping in a 30% aqueous nitric acid solution for 1 minute, and then thoroughly washed with water. Then, the sheet was subjected to electrolytic surface toughening at 22 A/dm$^2$ in 1.7% aqueous nitric acid solution for 45 seconds, then dipped in 2% aqueous NaOH solution at 30° C. to wash the surface and thereafter was washed with water. This sheet was further subjected to anodic oxidation in 20% aqueous sulfuric acid solution to form an aluminum oxide film on the surface, washed with water and then dried to make a support for printing plate. In this case, arithmetical mean deviation of the profile ($Ra_1$) of the treated surface of the support was 0.65 μm. Preparation of coating solution for photoconductive layer and coating thereof:

The following photoconductive layer composition dispersed for 1 hour in a paint shaker was coated by a bar coater on the treated surface of the support obtained above and then was subjected to hot-air rapid drying by a 1 kw hair dryer under the same conditions as in Example 1 to make an electrophotographic photoreceptor. In this case, coating amount of the photoconductive layer was 3.0 g/m$^2$ and arithmetical mean deviation of the profile ($Ra_2$) of the surface was 0.38 μm. (That is $0.5<Ra_2/Ra_1<1$).

| Composition of photoconductive layer coating solution 3: | Part by weight |
|---|---|
| Vinyl acetate/crotonic acid copolymer (crotonic acid 3 mol %) | 6 |
| Chloro Diane Blue | 2 |
| Diethylaminobenzaldehyde-N,N-diphenylhydrazone | 1 |
| 1,4-Dioxane | 84 |
| Dimethylformamide | 7 |
| Viscosity 70 cp (Measuring conditions: same as in Example 1) | |

The resulting photoreceptor was subjected to corona discharging in the dark to charge it so as to give a surface potential ($V_0$) of about −400 V. Thereafter, it was subjected to imagewise scanning exposure using He-Ne laser (633 nm) and immediately, the latent image was subjected to liquid development with positively charged toner (LOM-ED III manufactured by Mitsubishi Paper Mills Ltd.) and the toner was fixed by heating, whereby a toner image of 50 lines/nun in resolution with no indentation at edge of lines along the irregularity on the surface of the photoconductive layer was obtained in high reproducibility.

Next, plate-making treatment was carried out using the following decoating solution, water washing solution and rinsing solution.

| | Part by weight |
|---|---|
| Composition of decoating solution 2: | |
| Aqueous potassium silicate solution ($SiO_2$ content 20% by weight, $SiO_2/K_2O$ molar ratio 3.5) | 30 |
| Sodium hydroxide | 1 |
| Pure water | 69 |
| Composition of water washing solution 2 (20 dm$^2$): | |
| Sodium dioctylsulfosuccinate | 0.1 |
| Butyl p-hydroxybenzoate | 0.01 |

The above components were dispersed and dissolved in pure water to obtain 100 parts by weight of a solution. This solution was charged in the water washing tank and after making 100 plates, 15 ml of 5 wt % aqueous glycine solution was added after treating of every 10 printing plates of A2 size.

| Composition of rinsing solution 2 (20 $dm^2$): | Part by weight |
|---|---|
| Succinic acid | 0.2 |
| Citric acid | 0.3 |
| Sorbitan monolaurate | 0.05 |
| 2-Methyl-3-isothiazolone | 0.01 |

Sodium hydroxide was added to the above components to adjust pH to 4.7 and then, the total amount was made to 100 parts by weight with pure water.

Plate-making was carried out using the above treating solutions (decoating time was set at 6 seconds) to obtain an image of constant line width with no indentation at the edge of lines along the irregularity on the surface of the support. Side etching on one side was about 2 μm. No troubles such as delay in decoating of non-image portion (remaining of pigment) were seen in all of the printing plates made here.

Printing was carried out using these printing plates by an offset printing machine (Hamadastar 600 CD) to obtain at least 100,000 prints with good quality and no stains.

EXAMPLE 9

An aluminum sheet of JIS L050 was dipped in a aqueous NaOH solution at 50° C. to effect etching so that dissolution amount of aluminum reached 6 $g/m^2$. The aluminum sheet was washed with water, then neutralized by dipping in a 30% aqueous nitric acid solution for 1 minute, and then thoroughly washed with water. Then, the sheet was subjected to electrolytic surface roughening at 20 $A/dm^2$ in 2.0% aqueous hydrochloric acid solution for 60 seconds and subjected to desmutting treatment in 4% aqueous NaOH solution at 25° C., and then the surface was thoroughly washed with water. This sheet was further subjected to anodic oxidation in 20% aqueous sulfuric acid solution, washed with water and dried to make a support for printing plate. In this case, arithmetical mean deviation of the profile ($Ra_1$) of the treated surface of the support was 0.60 μm.

The following photoconductive layer composition dispersed for 1 hour in a paint shaker was coated by a bar coater on the treated surface of the support obtained above and then was dried in the same manner as in Example 1 to make an electrophotographic photoreceptor. In this case, coating amount of the photoconductive layer was 5.0 $g/m^2$ and arithmetical mean deviation of the profile ($Ra_2$) of the surface was 0.40 μm. (That is, $Ra_2/Ra_1=0.67$).

| Composition of photoconductive layer coating solution 4: | Part by weight |
|---|---|
| Butyl methacrylate/methacrylic acid copolymer (methacrylic acid 40 mol %) | 6 |
| Dibromoanthanthrone | 3 |
| 2-Propanol | 79 |
| Dimethylformamide | 10 |
| Viscosity 70 cp (Measuring conditions: same as in Example 1) | |

The resulting photoreceptor was subjected to corona discharging in the dark to charge it so as to give a surface potential ($V_0$) of about −400 V. Thereafter, a block copy image was projected on the surface by camera exposing and immediately, the latent image was subjected to liquid development with positively charged toner (LOM-ED III manufactured by Mitsubishi Paper Mills Ltd.) and the toner was fixed by heating, whereby a toner image of 30 lines/mm in resolution was obtained in high reproducibility. Sharpness of the image was superior.

Next, plate-making treatment was carried out using the treating solutions used in Example 8 (decoating time was set at 8 seconds) to obtain an image with side etching of about 3 μm on one side having slight variation and with no indentation at the edge of lines along the irregularity on the surface of the support. No troubles such as delay in decoating of non-image portion (remaining of pigment) were seen in all of the printing plates made here.

Printing was carried out using these printing plates by an offset printing machine (Hamadastar 600 CD) to obtain at least 100,000 prints with good quality and no stains.

As explained above, the present invention provides an electrophotographic photoreceptor for lithographic printing plate from which a printing plate having images of high resolution with no indentation at edges of the images and high in water retainability with no stains in the printed copies and having high printing endurance equal or higher than conventional printing plates can be made.

What is claimed is:

1. An electrophotographic photoreceptor which comprises the following:

an electrically conductive support and a photoconductive layer of 5 $g/m^2$ or less comprising at least an organic photoconductive compound and an alkali and/or alcohol soluble binder resin provided on said support wherein the weight ratio of the photoconductive compound to the binder resin in the photoconductive layer is 1/20 or higher, said photoreceptor being used for making a lithographic printing plate therefrom by electrophotographically forming a toner image and decoating the photoconductive layer of non-image portion other than the toner image portion by contacting with an alkaline decoating solution, wherein an arithmetical means deviation of profile ($Ra_1$) of the surface of said electrically conductive support having said photoconductive layer thereon is 0.3–1.0 μm and a ratio of $Ra_2/Ra_1$ of an arithmetical means deviation of profile ($Ra_2$) of the surface of said photoconductive layer and the ($Ra_1$) is 0.5–1.0.

2. A method for making a lithographic printing plate from the photoreceptor of claim 1 which comprises charging the photoconductive layer, exposing imagewise the photoconductive layer to form a latent image, developing the latent image with a toner, and decoating the photoconductive layer of non-image portion other than the toner image portion by contacting with an alkaline decoating solution.

3. A printing method which comprises mounting on an offset printing machine the lithographic printing plate made by the method of claim 2 and carrying out printing.

4. An electrophotographic photoreceptor according to claim 1, wherein the organic photoconductive compound comprises at least an organic pigment.

5. An electrophotographic photoreceptor according to claim 1, wherein the weight ratio of the photoconductive compound to the binder is 1 to 6 or more.

6. An electrophotographic photoreceptor according to claim 1, wherein the coating amount of the photoconductive layer is 1.5–4 $g/m^2$.

* * * * *